United States Patent [19]

Siklosi

[11] Patent Number: 4,692,277

[45] Date of Patent: Sep. 8, 1987

[54] HIGHER MOLECULAR WEIGHT DIOLS FOR IMPROVED LIQUID CLEANERS

[75] Inventor: Michael P. Siklosi, Cincinnati, Ohio

[73] Assignee: The Procter & Gamble Company, Cincinnati, Ohio

[21] Appl. No.: 811,268

[22] Filed: Dec. 20, 1985

[51] Int. Cl.[4] ..... C11D 1/22; C11D 3/20

[52] U.S. Cl. ..... 252/558; 252/174.19; 252/174.21; 252/546; 252/550; 252/551; 252/559; 252/531; 252/532; 252/539; 252/540; 252/DIG. 14

[58] Field of Search ..... 252/89.1, 174.21, 174.22, 252/174.19, 550, 551, 558, 559, 531, 532, 539, 540, DIG. 14

[56] References Cited

U.S. PATENT DOCUMENTS

| | | | |
|---|---|---|---|
| 2,679,482 | 5/1954 | Ross | 252/550 |
| 2,956,025 | 10/1960 | Lew | 252/559 |
| 2,997,447 | 8/1961 | Russell et al. | 252/351 |
| 3,463,735 | 8/1969 | Stonebraker et al. | 252/137 |
| 3,705,113 | 12/1972 | Sharman | 252/555 |
| 3,766,062 | 10/1973 | Wixon | 252/8.7 |
| 3,819,522 | 6/1974 | Zmoda et al. | 252/174.21 |
| 4,287,080 | 9/1981 | Siklosi | 252/104 |
| 4,294,728 | 10/1981 | Vanlerberghe et al. | 252/542 |
| 4,337,163 | 6/1982 | Schilp | 252/96 |
| 4,414,128 | 11/1983 | Goffinet | 252/111 |
| 4,434,067 | 2/1984 | Malone et al. | 252/88 |
| 4,537,706 | 8/1985 | Severson | 252/545 |

*Primary Examiner*—Prince E. Willis

*Attorney, Agent, or Firm*—Leonard Williamson; Ronald L. Hemingway; Richard C. Witte

[57] ABSTRACT

An improved liquid cleaner composition comprising:

(a) from about 0.1% to about 10% of a surfactant;

(b) from about 0.5% to about 25% of a $C_6$–$C_{16}$ diol;

(c) from about 1% to about 30% of a detergency builder; and (d) at least about 60% water.

12 Claims, No Drawings

HIGHER MOLECULAR WEIGHT DIOLS FOR IMPROVED LIQUID CLEANERS

TECHNICAL FIELD

This invention relates to liquid detergent compositions. In particular, it relates to aqueous detergent compositions suitable for use as general purpose household cleaning compositions.

BACKGROUND

Attention is directed to the liquid detergent compositions comprising benzyl alcohol and lower molecular weight ($C_1$–$C_3$) diols, U.S. Pat. No. 4,414,128, Goffinet, issued Nov. 8, 1983. Liquid cleansers comprising benzyl alcohol, surfactant, builder, and mild abrasives are also known. The prior art, however, fails to teach or recognize the advantage of high MW diols in a liquid cleaner formulation.

General purpose household cleaning compositions for hard surfaces such as metal, glass, ceramic, plastic and linoleum surfaces, are commercially available in both powdered and liquid form. Powdered cleaning compositions consist mainly of builder or buffering salts such as phosphates, carbonates, silicates, etc., and although such compositions may display good inorganic soil removal, they can be deficient in cleaning ability on organic soils such as the calcium and/or magnesium salts of fatty acids, commonly called soap scum or bathtub soil, and grease/fatty/oily soils typically found in the domestic environment. Moreover, they are inconvenient to use since they must be predissolved in water for use.

Liquid cleaning compositions, on the other hand, have the great advantage that they can be applied to hard surfaces in neat or concentrated form so that a relatively high level of surfactant material is delivered directly to the soil. Moreover, it is a rather more straightforward task to incorporate high concentrations of anionic or nonionic surfactant in a liquid rather than a granular composition. For both these reasons, therefore, liquid cleaning compositions have the potential to provide superior soap scum, grease, and oily soil removal over powdered cleaning compositions.

Nevertheless, liquid cleaning compositions still suffer a number of drawbacks which can limit their consumer acceptability. Thus, they generally contain little or no detergency builder salts and consequently they tend to have poor cleaning performance on particulate soil and also lack "robustness" under varying water hardness levels. In addition, they can suffer problems of product form, in particular, inhomogeneity, lack of clarity, or inadequate viscosity characteristics for consumer use. Moreover, the higher in-product and in-use surfactant concentration necessary for improved grease handling raises problems of extensive suds formation requiring frequent rinsing and wiping on behalf of the consumer. Although oversudsing may be controlled to some extent by incorporating a suds-regulating material such as hydrophilic silica and/or silicone or soap, this in itself can raise problems of poor product stability and homogeneity and also problems associated with deposition of insoluble particulate or soap residues, particularly calcium scum, on the items or surfaces being cleaned, leading to filming, streaking and spotting.

It has now been determined that higher molecular weight diols incorporated into liquid cleaners can substantially improve their cleaning performance, without adversely impacting sudsing, filming, streaking or spotting.

One of the preferred diols of this invention is a well-known component of insect repellant compositions, another and its ester derivatives have been incorporated into plastics compositions. These diols, however, are believed to be novel in detergent compositions.

SUMMARY OF THE INVENTION

According to the present invention there is provided an aqueous liquid detergent composition characterized by:

An improved liquid cleaner composition comprising:

(a) from about 0.1% to about 10% of a nonsoap surfactant selected from anionic, cationic, nonionic, zwitterionic, amphoteric surfactants and mixtures thereof;

(b) from about 0.5% to about 25% of a diol selected from the group consisting of $C_6$–$C_{16}$ diols and mixtures thereof; wherein at least one hydroxy group of said diol is a primary or secondary hydroxy group;

(c) from about 1% to about 30% of a detergency builder salt; and (d) at least about 60% water.

DETAILED DESCRIPTION OF THE INVENTION

It has now been discovered that some of the defects of prior art liquid cleaning compositions can be minimized or overcome through the incorporation therein of a specified level of higher molecular weight diols in combination with detergency builders. Although the high molecular weight diols, as a class, have limited water-solubility, it has now been found that they can be incorporated into liquid cleaning compositions in homogeneous form, even under "cold" processing conditions, with the ability to provide excellent cleaning characteristics across the range of water hardness or grease/oily soils and inorganic particulate soils, as well as on marker ink, bathtub soil, calcium soap scum, etc., and excellent shine performance with low soil redeposition and little or no propensity to cause filming, streaking or spotting on surfaces washed therewith.

The present invention thus provides liquid detergent compositions which are stable homogeneous fluent liquids having excellent suds control across the range of usage and water hardness conditions and which provide excellent shile performance together with improved cleaning characteristics both on greasy-oily soils and on inorganic particulate soils with little tendency to cause filming or streaking on washed surfaces.

Aqueous liquid cleaners are used full strength or in further dilution in water by the consumer to clean a wide variety of hard surfaces.

The uses for such cleaning liquids are too numerous to be specified completely, but such liquids are useful for cleaning of painted surfaces, walls, floors, appliance exterior surfaces, tables, chairs, windows, mirrors, and so forth. It is understood that terms like $C_6$–$C_{16}$ diols and $C_8$–$C_{18}$ alkyl benzene sulfonate include singular compounds, as well as mixtures thereof. Also, their levels of use in the compositions of this invention are to be given the conservative interpretation of "about."

THE SURFACTANT

First, such liquid cleaners contain from 0.1% to 10% of a suitable surfactant. Successively more preferred ranges of surfactant inclusion are from 1% to 10% of a surfactant, and from 2% to 5% of a surfactant. Broadly, the surfactants useful for formulation of aqueous liquid cleaners are the usual ones for hard surface cleaners. Some specific surfactants are those in the broad surfactant disclosure of U.S. Pat. No. 4,287,020, Siklosi, issued Sept. 1, 1981, incorporated herein by reference in its entirety. The surfactant is a nonsoap detergent which falls into the following classes: anionic, cationic, nonionic, zwitterionic and amphoteric surfactants. This is taken from Col. 4 of U.S. Pat. No. 4,287,080, incorporated by reference herein before.

Preferred surfactants for use in such cleaners are one or more of the following: sodium linear $C_8$–$C_{18}$ alkyl benzene sulfonate (LAS), particularly $C_{11}$–$C_{12}$ LAS; the sodium salt of a coconut alkyl ether sulfate containing 3 moles of ethylene oxide; the adduct of a random secondary alcohol having a range of alkyl chain lengths of from 11 to 15 carbon atoms and an average of 2 to 10 ethylene oxide moieties, several commercially available examples of which are Tergitol 15-S-3, Tergitol 15-S-5, Tergitol 15-S-7, and Tergitol 15-S-9, all available from Union Carbide Corporation; the sodium and potassium salts of coconut fatty acids (coconut soaps); the condensation product of a straight-chain primary alcohol containing from bout 8 carbons to about 16 carbon atoms and having an average carbon chain length of from about 10 to about 12 carbon atoms with from about 4 to about 8 moles of ethylene oxide per mole of alcohol; an amide having one of the preferred formulas:

$$R-\overset{\overset{\displaystyle O}{\|}}{C}-N(R^1)_2$$

wherein R is a straight-chain alkyl group containing from about 7 to about 15 carbon atoms and having an average carbon chain length of from about 9 to about 13 carbon atoms and wherein each $R^1$ is a hydroxy alkyl group containing from 1 to about 3 carbon atoms; a zwitterionic surfactant having one of the preferred formulas in the broad surfactant disclosure above; or a phosphine oxide surfactant having one of the preferred formulas in the broad disclosure of semipolar nonionic surfactants. Another preferred class of surfactants is the fluorocarbon surfactants, examples of which are FC-129, a potassium fluorinated alkylcarboxylate and FC-170-C, a mixture of fluorinated alkyl polyoxyethylene ethanols, both available from 3M Corporation, as well as the Zonyl fluorosurfactants, available from DuPont Corporation. It is understood that mixtures of various surfactants may be used. An especially preferred surfactant for use herein is the sodium salt of linear $C_{11}$–$C_{12}$ alkyl benzene sulfonate (LAS).

THE DIOL

The second essential ingredient of aqueous liquid cleaners of the present invention is 0.5% to 25%, preferably 1% to 15%, of a diol having a least 6 carbon atoms in its molecular structure, or mixtures of diols having from 6 to 16 carbon atoms in their molecular structure. While any of the diols having from 6 to 16 carbon atoms can be used herein, those exemplary diols which carbon atoms are numbered 8, 10, and 12 are particularly preferred for use herein. Most preferred for use herein are the $C_8$ diols which are preferably used at a level of from 1% to 15%, preferably from about 3% to about 11% of the composition. The preferred diols of this invention are soluble up to about 20 g/100 g of water at 20° C. The more preferred diols have solubilities of 15 g, 10 g, 5 g, 1 g, down to 0.1 g/100 g of water. The most preferred diols have solubilities in the range of about 5 g to 0.1 g/100 g of water at 20° C. Some preferred diols are the $C_8$–$C_{12}$ diols which are preferably used at levels of from 1% to 15% and $C_8$–$C_{10}$ diols which are used at levels of from 2% to 15%. Also the $C_6$ diols are preferably used at a level of at least 15%.

Some examples of diols and their solubilities are shown in Table 1. Their solubilities are measured in distilled water at room temperature. Also shown are their qualitative effectiveness in removing insoluble calcium soap from a tile surface.

TABLE 1

Solubility of Selected Diols with Corresponding Qualitative Cleaning Results

| Alcohol | Solubility (g/100 g $H_2O$) | Cleaning Effectiveness |
|---|---|---|
| Propylene glycol | — | Slight |
| Dipropylene glycol | — | Slight |
| 2-Methyl-2,4-pentanediol | — | Slight |
| 2,2-Dimethyl-1,3-propanediol | >25.0* | Moderate |
| 1,4-Cyclohexanedimethanol | >20.0* | Moderate |
| 2,5-Dimethyl-2,5-hexanediol | 14.3 | Good |
| 2-Phenyl-1,2-propanediol | 12.0* | Good |
| Phenyl-1,2-ethanediol | 12.0* | Very Good** |
| 2-Ethyl-1,3-hexanediol | 4.2 | Very Good |
| 2,2,4-Trimethyl-1,3-pentanediol | 1.9 | Very Good |
| 1,2-Octanediol | <1.0* | Very Good |

*Determined via laboratory measurements. All other values are from published literature.

**Note that cleaning effectiveness is very good despite relatively high water solubility.

THE BUILDER SALT

A third required component of the aqueous liquid cleaners of the present invention is 1% to 30%, preferably from about 1% to about 15%, of a builder salt. While any of the builders or inorganic salts described above in connection with powdered nonabrasive cleaners may be used herein as builders, the preferred builders for use herein are sodium nitrilotriacetate, potassium pyrophosphate, potassium tripolyphosphate, sodium or potassium ethane-1-hydroxyl-1,1-diphosphonate, sodium citrate, sodium carbonate, sodium sulfite, sodium bicarbonate, and so forth. One class of builders particularly useful herein are the fugitive builders, in particular aqueous ammonia, ordinarily described in its aqueous form as ammonium hydroxide. Most preferred builders for use herein are sodium carbonate, sodium bicarbonate, tetrapotassium pyrophosphate, sodium nitrilotriacetate, sodium N-(2-hydroxyethyl)-iminodiacetate, and sodium N-(2-hydroxypropyl)-iminodiacetate, and the like, sodium sulfite, and ammonium hydroxide, as well as mixtures of these preferred materials. Potassium pyrophosphate and sodium citrate are preferred builders and are preferably used at a level of from about 1% to about 15%.

THE OPTIONALS

An optional ingredient which is sometimes highly desirable in aqueous liquid cleaners is a hydrotrope which serves to stabilize the compositions by aiding in the solubilization of their components. From about 0.1% to about 12% of the hydrotroping agent is used, particularly in compositions with less soluble diols or higher amounts of diols. The hydrotroping agent is selected from the group consisting of alkali metal, ammonium, triethanolammonium isopropylbenzene sulfonates, xylene sulfonates, toluene sulfonates, benzene sulfonates, 5 (or 6)-carboxy-4-hexyl-2-cyclohexane-1-octanoic acid available from Westvaaco Corporation, and mixtures thereof. Specific hydrotroping agents found to be useful herein are sodium cumene sulfonate and potassium toluene sulfonate.

In many applications it will be highly desirable to incorporate a suds suppressor as an optional ingredient in the aqueous liquid cleaners herein. The purpose of this ingredient is to eliminate the need to repetitively rinse a surface after it is washed in order to remove all visible traces of the surfactant. The composition should contain about 1% or less of the suds suppressor, if it is used. One example is the sodium or potassium salt of a coconut fatty acid. Another example of a suitable suds suppressor is a surfactant which is the condensation product of a straight-chain random secondary alcohol having a chain length of from about 11 to about 15 carbon atoms and having an average length of from about 12 to about 15 carbon atoms with from about 1 to about 3 moles of ethylene oxide.

The balance of the composition (60% to 98%) is water, preferably soft water in order to minimize the initial load on the sequestering builders.

A further discussion of the requirements and formulation of aqueous liquid cleaners is found in U.S. Pat. Nos. 4,287,020, Siklosi, supra; 3,679,608, Aubert et al., issued July 25, 1972; and 3,970,594, Claybaugh, issued July 20, 1976. The foregoing three patents are incorporated herein by reference.

The following examples are illustrative only and are in no way limiting in terms of reflecting the fair scope and the full spirit of the present invention.

EXAMPLES

Preparation of Simulated Bathtub Soil

Into 270 grams of isopropyl alcohol is placed 30 grams of the calcium salt of stearic acid. The mixture is stirred (in a blender) and 0.2 grams of finely divided charcoal is added. The material is stirred until the charcoal is well blended. The calcium stearate solution is placed in a Pre-Val sprayer. The soil is sprayed onto smooth, 3 inch×13 inch porcelain plates in a fume hood. The plates are laid lengthwise inclined at a slight (15°) angle. An even flow of soil is established. The sprayer is held 18 inches from the plate, while spraying across the plates four times (counting left to right and back as one). The plates are baked at 180° C. for 20 minutes. After cooling, the plates are ready for use in cleaning tests.

Cleaning of Simulated Bathtub Soil

A Gardner Model M-105-A Washability and Abrasion Machine, made by Gardner Laboratories, Inc., Bethesda, Md., a device for mechanically passing a sponge across a flat surface in a uniform and reproducible manner, is used for soil removal testing. A sponge is moistened with water to a weight of 25 grams and 1.0 gram of product is aded; a weight (1300 g) is added to the sponge carriage.

The porcelain plates are cleaned with each product being tested to about 99% clean by visual observation. The strokes needed to reach this level of cleaning are recorded. The number of strokes needed are entered into the following formula: (The nonsolvent-containing cleaner is always rated a 10.)

$$\text{Scale Rating} = \frac{1}{\text{number strokes for test product}} \times 10 \times \text{number strokes for nonsolvent-containing cleanser}$$

EXAMPLE I

| Component | Wt. % |
|---|---|
| Sodium LAS ($C_{12}$ benzene sulfonate) | 2.21 |
| Coconut Fatty Acid | 0.96 |
| Sodium Carbonate | 1.49 |
| Sodium Bicarbonate | 1.20 |
| Tetrapotassium Pyrophosphate | 11.52 |
| Sodium Sulfite | 0.24 |
| Sodium Cumene Sulfonate | 6.72 |
| Ammonia | 0.72 |
| Minors (perfume, color, etc.) | 2.09 |
| 2-Ethyl-1,3-hexanediol | 4.00 |
| Soft Water | 68.85 |

The materials above are combined and stirred until dissolved.

When this composition was tested for removal of simulated bathtub soil, it was found to remove the soil with a scale rating of 87, while the formulation without 2-ethyl-1,3-hexanediol had a scale rating of 10. The higher the scale rating the better the cleaning. Thus, the formula with the diol is more than 8 times better than the formula without the diol.

EXAMPLE II

| Component | Wt. % |
|---|---|
| Sodium LAS ($C_{12}$ benzene sulfonate) | 2.07 |
| Coconut Fatty Acid | 0.90 |
| Sodium Carbonate | 1.40 |
| Sodium Bicarbonate | 1.12 |
| Tetrapotassium Pyrophosphate | 10.80 |
| Sodium Sulfite | 0.23 |
| Sodium Cumene Sulfonate | 6.30 |
| Ammonia | 0.67 |
| Minors (perfume, color, etc.) | 1.96 |
| 2,2,4-Trimethyl-1,3-pentanediol | 10.00 |
| Soft Water | 64.62 |

The materials above are combined and stirred until dissolved.

When this composition was tested for removal of simulated bathtub soil, it was found to remove the soil with a scale rating of 113, while the formulation without 2,2,4-trimethyl-1,3-pentanediol had a scale rating of 10. The higher the scale rating the better the cleaning. Thus, the formula with the diol is more than 11 times better than the formula without the diol.

EXAMPLE III

| Component | Wt. % |
|---|---|
| Sodium LAS ($C_{12}$ benzene sulfonate) | 2.07 |
| Coconut Fatty Acid | 0.90 |
| Sodium Carbonate | 1.40 |
| Sodium Bicarbonate | 1.12 |
| Tetrapotassium Pyrophosphate | 10.80 |
| Sodium Sulfite | 0.23 |
| Sodium Cumene Sulfonate | 6.23 |
| Ammonia | 0.67 |
| Minors (perfume, color, etc.) | 1.96 |
| 1,2-Octanediol | 10.00 |

-continued

| Component | Wt. % |
|---|---|
| Soft Water | 64.62 |

The materials above are combined and stirred until dissolved.

When this composition was tested for removal of simulated bathtub soil, it was found to remove the soil with a scale rating of 103, while the formulation without 1,2-otanediol had a scale rating of 10. The higher the scale rating the better the cleaning. Thus, the formula with the diol is more than 10 times better than the formula without the diol.

EXAMPLE IV

| Component | Wt. % |
|---|---|
| Sodium LAS ($C_{12}$ benzene sulfonate) | 2.07 |
| Coconut Fatty Acid | 0.90 |
| Sodium Carbonate | 1.40 |
| Sodium Bicarbonate | 1.12 |
| Tetrapotassium Pyrophosphate | 10.80 |
| Sodium Sulfite | 0.23 |
| Sodium Cumene Sulfonate | 6.23 |
| Ammonia | 0.67 |
| Minors (perfume, color, etc.) | 1.96 |
| Phenyl-1,2-ethanediol | 10.00 |
| Soft Water | 64.62 |

The materials above are combined and stirred until dissolved.

When this composition was tested for removal of simulated bathtub soil, it was found to remove the soil with a scale rating of 100, while the formulation without phenyl-1,2-ethanediol had a scale rating of 10. The higher the scale rating the better the cleaning. Thus, the formula with the diol is more than 10 times better than the formula without the diol.

| Component | Wt. % |
|---|---|
| Sodium LAS ($C_{12}$ benzene sulfonate) | 2.07 |
| Coconut Fatty Acid | 0.90 |
| Sodium Carbonate | 1.40 |
| Sodium Bicarbonate | 1.12 |
| Tetrapotassium Pyrophosphate | 10.80 |
| Sodium Sulfite | 0.23 |
| Sodium Cumene Sulfonate | 6.23 |
| Ammonia | 0.67 |
| Minors (perfume, color, etc.) | 1.96 |
| DL-2-phenyl-1,2-propanediol | 10.00 |
| Soft Water | 64.62 |

The materials above are combined and stirred until dissolved.

When this composition was tested for removal of simulated bathtub soil, it was found to remove the soil with a scale rating of 75, while the formulation without DL-2-phenyl-1,2-propanediol had a scale rating of 10. The higher the scale rating the better the cleaning. Thus, the formula with the diol is more than 7 times better than the formula without the diol.

EXAMPLE VI

| Component | Wt. % |
|---|---|
| Sodium LAS ($C_{12}$ benzene sulfonate) | 2.88 |
| Coconut Fatty Acid | 0.14 |
| Sodium Carbonate | 2.88 |

-continued

| Component | Wt. % |
|---|---|
| Sodium Citrate | 3.36 |
| Sodium Cumene Sulfonate | 3.84 |
| Minors (perfume, color, etc.) | 0.81 |
| 2-Ethyl-1,3-hexanediol | 4.00 |
| Soft Water | 82.09 |

The materials above are combined and stirred until dissolved.

When this composition was tested for removal of simulated bathtub soil, it was found to remove the soil with a scale rating of 48, while the formulation without 2-ethyl-1,3-hexanediol had a scale rating of 10. The higher the scale rating the better the cleaning. Thus, the formula with the diol is more than 4 times better than the formula without the diol.

EXAMPLE VII

| Component | Wt. % |
|---|---|
| Sodium LAS ($C_{12}$ benzene sulfonate) | 2.00 |
| N—(2-hydroxyethyl) iminodiacetic acid, disodium salt | 5.00 |
| Butyl Carbitol | 2.40 |
| Sodium Cumene Sulfonate | 2.00 |
| 2,2,4-Trimethyl-1,3-pentanediol | 4.00 |
| Minors (perfume, color, etc.) | 0.20 |
| Soft Water | 84.40 |

The materials above are combined and stirred until dissolved.

When this composition was tested for removal of simulated bathtub soil, it was found to remove the soil with a scale rating of 44, while the formulation without 2,2,4-trimethyl-1,3-pentanediol had a scale rating of 10. The higher the scale rating the better the cleaning. Thus, the formula with the diol is more than 4 times better than the formula without the diol.

What is claimed is:

1. A hard surface liquid cleaner composition consisting essentially of:

(a) from about 0.1% to about 10% of a nonsoap surfactant selected from the group consisting of: anionic, cationic, nonionic, zwitterionic, amphoteric surfactants and mixtures thereof;

(b) from about 0.5% to about 25% of a diol selected from the group consisting of $C_6$–$C_{12}$ diols and mixtures thereof; wherein at least one hydroxy group of said diol is a primary or secondary hydroxy group and wherein said diol has a maximum solubility of about 12 g/100 g of water at 20° C.;

(c) from about 1% to about 30% of a detergency builder salt; and (d) at least about 60% water.

2. The liquid cleaner of claim 1 wherein said cleaner comprises 1% to 15% of a diol selected from the group consisting of $C_8$–$C_{12}$ diols and mixtures thereof.

3. The liquid cleaner of claim 1 wherein the surfactant is anionic.

4. The liquid cleaner of claim 1 wherein the surfactant is a mixture of anionic and nonionic types.

5. The liquid cleaner of claim 1 wherein said liquid cleaner comprises:

(a) 1% to 5% of sodium alkyl ($C_8$–$C_{18}$) benzene sulfonate (LAS) surfactant;

(b) 2% to 15% of a $C_8$–$C_{10}$ diol; and (c) 1% to 15% tetrapotassium pyrophosphate builder.

6. The liquid cleaner of claim 1 wherein said liquid cleaner comprises:

(a) 1% to 5% of sodium alkyl ($C_8$–$C_{18}$) benzene sulfonate (LAS) surfactant;

(b) 1% to 15% of a $C_8$ diol; and (c) 1% to 15% tetrapotassium pyrophosphate builder.

7. The liquid cleaner of claim 1 wherein said liquid cleaner comprises:

(a) 1% to 5% of sodium alkyl ($C_8$–$C_{18}$) benzene sulfonate (LAS) surfactant;

(b) 2% to 15% of a $C_8$–$C_{10}$ diol; and (c) 1% to 15% sodium citrate builder.

8. The liquid cleaner of claim 1 wherein said liquid cleaner comprises:

(a) 1% to 5% of sodium alkyl ($C_8$–$C_{18}$) benzene sulfonate (LAS) surfactant;

(b) 1% to 15% of a $C_8$ diol; and (c) 1% to 15% sodium citrate builder.

9. The liquid cleaner of claim 1 wherein said diol is 2-ethyl-1,3-hexandiol.

10. The liquid cleaner of claim 1 wherein said diol is a $C_6$ and is present at a level of at least 15%.

11. The liquid cleaner of claim 1 wherein said diols have a solubility of from about 0.1 g to about 20 g in 100 g of water at 20° C.

12. The liquid cleaner of claim 11 wherein said solubility is from about 0.1 g to about 5 g/100 g of water at 20° C.

* * * * *